US008075333B2

(12) United States Patent
Bolik et al.

(10) Patent No.: US 8,075,333 B2
(45) Date of Patent: Dec. 13, 2011

(54) ELECTRIC PLUG CONNECTOR WITH GUIDE

(75) Inventors: Thomas Bolik, Hannover (DE); Michael Kaufmann, Gehrden (DE); Ulrich Overhage, Garbsen (DE); Olaf Wichmann, Wennigsen (DE)

(73) Assignee: WABCO GmbH, Hannover (DE)

( * ) Notice: Subject to any disclaimer, the term of this patent is extended or adjusted under 35 U.S.C. 154(b) by 147 days.

(21) Appl. No.: 12/310,952

(22) PCT Filed: Sep. 6, 2007

(86) PCT No.: PCT/EP2007/007762

§ 371 (c)(1),
(2), (4) Date: Sep. 15, 2009

(87) PCT Pub. No.: WO2008/031526

PCT Pub. Date: Mar. 20, 2008

(65) Prior Publication Data

US 2010/0015841 A1 Jan. 21, 2010

(30) Foreign Application Priority Data

Sep. 13, 2006 (DE) ..... 10 2006 042 924

(51) Int. Cl.
*H01R 13/64* (2006.01)

(52) U.S. Cl. ..... 439/374; 439/604

(58) Field of Classification Search ..... None
See application file for complete search history.

(56) References Cited

U.S. PATENT DOCUMENTS

| | | | | |
|---|---|---|---|---|
| 4,772,226 | A | 9/1988 | Schlesinger | |
| 4,820,204 | A * | 4/1989 | Batty | 439/681 |
| 4,828,509 | A | 5/1989 | Vogel | |
| 5,820,395 | A * | 10/1998 | Hashizawa | 439/271 |
| 6,402,549 | B1 * | 6/2002 | Ayres et al. | 439/578 |
| 7,131,873 | B2 * | 11/2006 | Miyake et al. | 439/680 |
| 7,214,103 | B2 * | 5/2007 | Kim et al. | 439/680 |

FOREIGN PATENT DOCUMENTS

| | | |
|---|---|---|
| DE | 30 12 292 A1 | 10/1981 |
| DE | 36 30 600 C1 | 11/1987 |
| GB | 2 161 996 A | 1/1986 |

* cited by examiner

*Primary Examiner* — Michael Zarroli
(74) *Attorney, Agent, or Firm* — Kramer Levin Naftalis & Frankel LLP

(57) ABSTRACT

A plug having a guide, which has a first guiding section and a second guiding section for guiding the plug into a corresponding plug receptacle. The second guiding section is disposed at a greater distance from the plug face than the first guiding section. The first guiding section and the second guiding section have contours in their respective cross-sections that are different from one another.

10 Claims, 4 Drawing Sheets

B - B'

C - C'

ELECTRIC PLUG CONNECTOR WITH GUIDE

FIELD OF THE INVENTION

The present invention generally relates to an electrical plug connection with a guide.

BACKGROUND OF THE INVENTION

Plug connectors having plugs and associated plug housings are ubiquitous. In the automobile sector, plugs of the most diverse types are used throughout the wiring of electrical systems. In this regard, it is frequently of great importance that the plug connection be extremely robust relative to forces originating from the connected cables. Under high mechanical stress, such as would occur in transport vehicles, vibrations and long cable lengths may cause damage to plug connections. This may lead to malfunctions. It is therefore generally desirable to provide plug connectors that are as robust as possible while, nevertheless, requiring minimal space, and that permit convenient operator control, or, in other words, simple disconnection and reconnection of the plug connection. Furthermore, provision should be made such that the plugs are inserted in a functionally proper manner into the respective, correct housing device. In this regard, the plug housing generally constitutes a type of guide for the plug in order to give it support in the plug housing.

Besides the general requirement that a corresponding plug housing must exist for a plug, special requirements apply if the plug is inserted from underneath, for example, into the associated plug housing, where the cables are led away from the plug at an angle. Thus, there are known plug connections which, in order to ensure that the plug connection is as secure as possible, are provided with a guide length equal to more than twice the diameter of the plug face. This guide length is the region in which at least portions of the plug are surrounded in form-fitting manner by the plug housing. In the case of electrical contacting in motor vehicles, an additional cable fixation is generally necessary directly behind the plug. Other known systems use metal clips, which are deformed in a manner that exerts force or are permanently fixed. As a result, the plug connection may not be disconnected inadvertently by inertial forces of the cable. A disadvantage of the known plug connections is the long guide length, which also leads to a large space requirement. For example, if the guide length is twice the diameter of the plug face, the space requirement, including the necessary travel for separation of the plug connection, is approximately four times the diameter of the plug face, to which there is added the length of the plug housing located outside the guide. Alternative solutions using the metal clips discussed above or using screwed connections are associated with high costs or with considerable time and effort for mounting and demounting. Such plug connections are inconvenient when there are repetitive disconnection and connection.

SUMMARY OF THE INVENTION

Generally speaking, it is an object of the present invention to provide a plug connection that permits a secure plug connection but nevertheless keeps the space requirement small.

In accordance with exemplary embodiments of the present invention, a plug with guide is provided, which has a first guide portion and a second guide portion for guiding the plug in a corresponding plug housing. The second guide portion is disposed further from the plug face than the first guide portion, and the contours of the respective cross sections of the first guide portion and the second guide portion are different from one another. By virtue of the advantageous division of the plug guide into a first and a second guide portion, the capabilities of the plug and, thus, of the plug connection can be advantageously redefined. According to exemplary embodiments of the present invention, the first guide portion can be made shorter than the second guide portion so as to limit the disconnection travel of the plug (during extraction of the plug from the corresponding plug housing) to the length of one of the two guide portions. Guiding of the plug in the corresponding plug housing can end as soon as the plug has been removed when either the first or the second guide portion has exited completely from the corresponding guide portions of the plug housing. In particular, the guide portions can be disposed on the handle of the plug, which is usually not used for guiding the plug in the plug housing.

According to an advantageous embodiment of the present invention, the first guide portion and the second guide portion are separated from one another by a region that does not bring about any guidance in the corresponding plug housing. Such division into two guide portions, wherein the first adjoins the plug face (which is the front end of the plug, where the contacts are typically disposed), for example, or is disposed in close proximity to the plug face, and the second is disposed further behind on the plug housing, substitutes for continuous guidance over the entire plug. In this way, an effective guide is provided, which achieves the effect of a guide having a length corresponding to the distance from the front end of the first guide portion to the rear end of the second guide portion, without the need for a continuous guide for the plug between these ends in the plug housing. As a result, the middle portion can be used in a completely different manner. For example, it is possible in this case to provide locking means or the like, which are pushed into the guide-free region around the circumference of the plug housing, which, for example, is constricted there. Moreover, additional possibilities exist for introducing other elements in this region, which elements need not bear in form-fitting manner on the guide housing or which cooperates with the housing in a manner different than that in the guide portions. The plug housing must be constructed to correspond to the plug so that the guide is formed or is omitted between the guide portions.

According to another exemplary embodiment of the present invention, the second guide portion is provided by a plug part separate from the first guide portion, whereby the plug part is formed in particular by a connecting element, an overmolding or a mounted element, each of which—depending on configuration—is rigidly joined to the plug. This advantageous configuration provides that an overmolding of part of the plug receives an additional component, which is designed and used for guiding the plug in the plug housing. This necessitates additional steps for providing the overmolding or the dies that produce the overmolding. Since this entails additional time and effort in the manufacture of plugs, common plugs do not have any guide means in the region of the handle of the plug. According to exemplary embodiments of the present invention, however, it was recognized that an advantage may be gained for certain applications, thus justifying the additional time and effort. To this extent, a part of the overmolding that was conventionally provided only as a handle for extracting the plug, for example, is now also configured as a second guide portion for guiding the plug. According to an exemplary embodiment of the present invention, the additional functions of the overmolding, such as provision of mechanical stability between plug and connecting cable, remain unaffected by the guiding capabilities of the second guide portion in the handle region.

According to an exemplary embodiment of the present invention, an inventive plug is provided on the second guide portion with a guide means disposed on the circumferential surface of the plug, whereby the guide is oriented in the direction of insertion of the plug. This guide means can have almost any desired guide contour. Advantageously, it can be a guide rib, for example. A guide rib is one of many configurations, wherein such guide ribs advantageously engage in corresponding guide grooves of associated plug housings and, thus, offer the plug the desired guidance and support. Due to the configuration of the guide means as a guide rib, it is possible to achieve the inventive subdivision into a first and second guide portion. Furthermore, because of the rib form, the length of the guide can be configured easily and flexibly. Nevertheless, other constructions are also possible, wherein, for example, a guide groove is provided in the plug and the plug housing has a corresponding guide rib. The division into a first guide portion and a second guide portion as described above is also possible in principle in this way. Constructions with a plurality of guide ribs or a plurality of guide grooves are also conceivable. In particular, a dovetail construction, a trapezoidal construction and various other contours can also be considered as guide means in addition to the rib form.

According to another exemplary embodiment of the inventive plug, yet a further coding rib is disposed in the second guide portion to permit preemptive coding of the plug. In this context, preemptive coding means that the coding rib is disposed such that the coding rib already engages in a corresponding guide groove at the highest point, or, in other words, upon first contact with a plug housing. If no corresponding groove is provided, the plug is prevented from fitting into the plug housing. This coding preempts other coding options, for example, in the first guide portion, because, at this time, the plug, and especially its first guide portion, is not yet sufficiently deep in the plug housing. Other advantageous configurations of this exemplary aspect of the invention are not limited to the arrangement of one guide rib but can be provided with different arrangements of ribs and grooves, especially on the plug housing, which also bring about preemptive coding.

According to another exemplary embodiment of the present invention, the inventive plug has a smaller cross section in the first guide portion than in the second guide portion. According to this exemplary aspect of the present invention, the term "cross section" relates to a maximum cross section of the first guide portion compared with a maximum cross section of the second guide portion. Generally expressed, the first guide portion is made with a smaller or narrower cross section than the second guide portion, such that the first guide portion has a freedom of lateral movement relative to the insertion direction, relatively unrestricted by guidance, in the region of the plug housing corresponding to the second guide portion. As a result, during disconnection of the plug, the plug can already be removed without hindrance from the plug housing when only the first or the second guide portions has exited the guide in the plug housing. Depending on construction or guide length of the plug in the plug housing, the disconnection travel then amounts only to the length of the first or second guide portion. This exemplary aspect of the present invention also encompasses solutions in which less than the full length of the first or second guide portion is involved in guidance with the corresponding plug housing. In such solutions it is possible to obtain guide lengths that do not correspond to the exact length of the first or second guide portion of the plug. In particular, according to this advantageous aspect of the present invention, the first guide portion is allowed by its smaller cross section to move freely within the second guide portion in the plug housing. In another exemplary embodiment, the disconnection travel is obtained merely from the guide length of the second guide portion or from a guide length shorter than the second guide portion.

In accordance with exemplary embodiments of the present invention, a plug connection is provided having a plug and a corresponding plug housing, wherein the plug housing is configured such that it permits guidance of the plug according to the guide portions as described above.

According to an exemplary embodiment of the present invention, guide grooves corresponding to the guide ribs of the second guide portion of the inventive plug are provided in the plug housing. These guide grooves of the second guide portion can be open toward the front relative to the direction of insertion of the plug. Consequently, if the plug housing is dirty, the contamination can be pushed forward out of the grooves by inserting the plug. For certain plug types, it may be advantageous instead to configure the plug connection in such a way that the dirt can be pulled out and disposed of by extracting the plug.

According to another exemplary embodiment of the present invention, the effective guide length in the direction of main stress has a guide ratio of approximately 3 relative to the diameter of the plug face. In this regard, the deciding factor is the diameter of the plug face in the direction of the main stress. For example, if a cable is led away from the plug housing at an angle, the direction of the main stress coincides with the tension direction of the cable. The cable exerts a torque on the plug. The plug needs a guide in order to withstand the tension of the cable. Advantageously, therefore, the guide is configured such that it has its strongest effect in this direction. In the inventive plug connection, a particularly high guide ratio can be achieved by virtue of the two-piece or multi-piece configuration of the guide, without the need to make the guide continuous over the entire length of the plug housing.

According to an exemplary embodiment of the present invention, a third guide portion is provided, which is disposed between the first and second guide portions and is separated from the second guide portion by a region in which no guidance of the plug is imposed. According to this advantageous configuration, the second guide portion may be prolonged by the third guide portion, provided the third guide portion has an outline or a cross section that corresponds to the second guide portion. The distance between the two guide portions without direct guiding capabilities can be used to insert a locking element, which holds the plug in a fixed position.

Still other objects and advantages of the present invention will in part be obvious and will in part be apparent from the specification.

The present invention accordingly comprises the features of construction, combination of elements, and arrangement of parts that will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which.

DETAILED DESCRIPTION OF THE PREFERRED EMBODIMENTS

Figure 1:
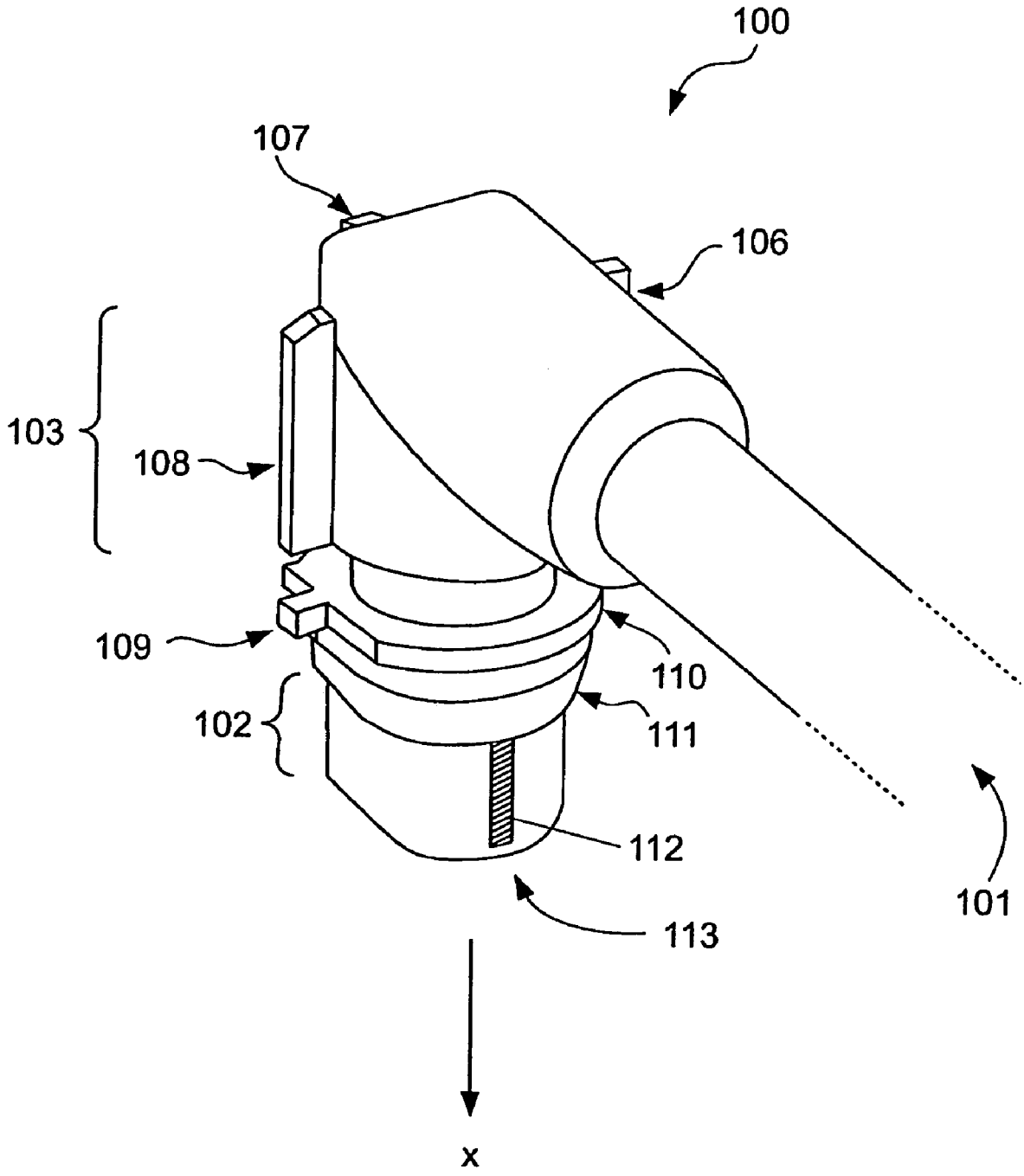
FIG. 1 is a perspective view of a plug in accordance with an embodiment of the present invention.

Referring now to the drawing figures, FIG. 1 shows an inventive plug 100 for connection of a cable or of a bundle of electrical lines 101. Electrical line 101 is bent at an angle of 90° in the housing of plug 100 and is coupled with, or in other words, electrically connected to, the contacts on plug face 113 (contacts not illustrated). Plug 100 has a first guide portion 102 and a second guide portion 103. First guide portion 102 is disposed in direct spatial proximity to plug face 113. Guidance in first guide portion 102 is effected, for example, by form-fitting engagement of first guide portion 102 into a corresponding housing portion. Further markings or inscriptions 112 can be provided in the first guide portion. A sealing element 111 is disposed above first guide portion 102 and surrounds the circumference of plug 100 in order to ensure protection against moisture and dirt for the guide regions, which are mounted in a pot-shaped opening closed at the rear, and for the contacts, which can have any desired form and advantageously are constructed as flat contacts, round contacts or the like. A third guide portion 110 having a guide rib 109 is disposed above sealing element 111. Third guide portion 110 can be advantageously constructed as an extension of second guide portion 103. During insertion of plug 100 into the housing, the guide elements of third guide portion 110 first engage in the corresponding guides of the second guide portion. In this way, it is possible to achieve a preliminary adjustment, which facilitates overmolding of the plug. This constitutes a further advantageous aspect of the present invention.

Third guide portion 110 is constructed at a distance from second guide portion 103 disposed above it, so that a locking element (not illustrated, but having the form of a locking slide), can be pushed on perpendicular to the direction X of insertion of the plug. In this way, the locking element can lock the plug in a corresponding housing. Furthermore, the present exemplary embodiment of an inventive plug has a second guide portion 103, which is disposed, for example, in the handle region of the plug. Further guide ribs 106, 108 are provided in this region. During insertion of plug 100 into a corresponding plug housing, the guide ribs of second guide portion 103 and of third guide portion 110 engage in grooves corresponding to the guide ribs. According to an advantageous configuration, a further rib in second guide portion 103 can be used as a preemptive coding rib 107. The offset of coding rib 107 in the front region of the plug (in other words, an offset of the coding rib in the horizontal direction, on the circumference of the plug) ensures that the plug fits only certain plug housings. In particular, coding rib 107 can be disposed such that it permits insertion of the plug upon first contact with the plug housing, or prevents such insertion if no corresponding groove is present on the plug housing. This is referred to as preemptive coding because it acts upon first contact of the plug with the plug housing. In addition, according to an advantageous configuration of coding rib 107, it also has a guiding capability if desired, in a manner that can correspond to that of guide ribs 106, 108. However, the guiding effect of coding rib 107 can takes place in a direction different from that of guide ribs 106, 108.

Figure 2:
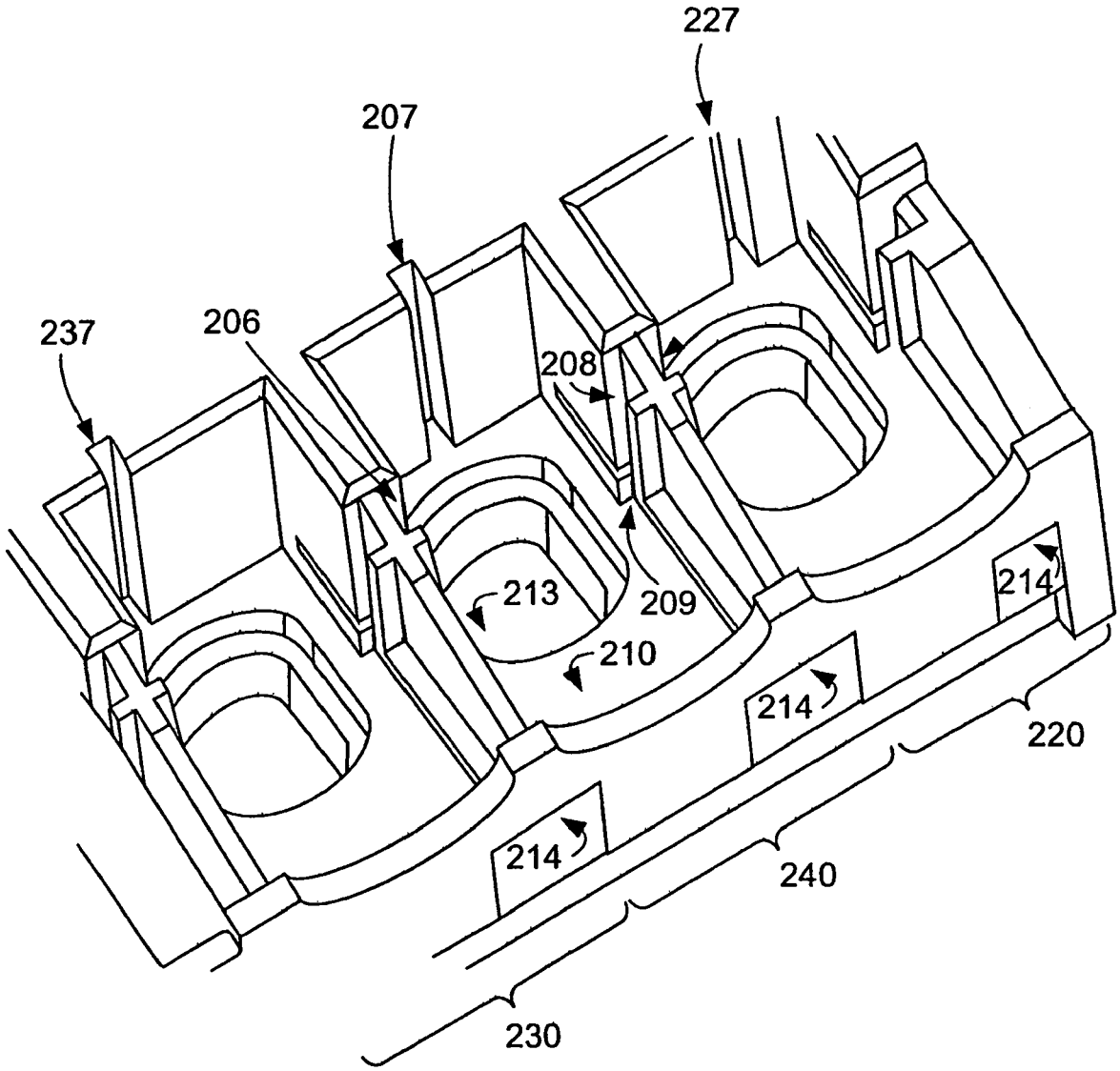
FIG. 2 is a perspective view of a plug housing in accordance with an embodiment of the present invention.

FIG. 2 shows a plug housing 240 corresponding to plug 100. A possible spatial arrangement of a plurality of different exemplary embodiments of inventive plug housings 240, 220 and 230 disposed next to one another is also illustrated in FIG. 2. Only plug housing 240, which is the middle portion in FIG. 2, is configured to receive plug 100 illustrated in FIG. 1. A contact region 213 for making electrical contact is visible. Starting from this contact region 213, the guide extends along the direction of insertion of plug 100 and along first guide portion 102, as illustrated in FIG. 1. Above this housing part corresponding to first guide portion 102, there is disposed a portion in which seal 111 illustrated in FIG. 1 is disposed, thus protecting inner contact region 213 from dirt or the like. Sealing element 111 of the plug is advantageously configured elastically in order to compensate for tolerances, and it rests axially on region 210. Moreover, plug housing 240 offers guide grooves 206 and 208 for receiving guide ribs 106 and 108 of plug 100 according to FIG. 1. Between the first guide portion and guide grooves 206 and 208 of the second guide portion, there is provided a recess 209, in which guide rib 109 (or guide pins 109) of third guide portion 110 can engage. In this way, an advantageous pre-adjustment (at 208) of the plug for the guide grooves of the overmolding (106 and 108) during assembly of the plug can be achieved. By virtue of the subdivision into the different guide portions, it is possible to pre-adjust the inventive plug advantageously in an overmolding die provided for this purpose. Therefore, third guide portion 110 is advantageously constructed as an extension of second guide portion 103. Moreover, it is advantageously disposed close to first guide portion 102. When the plug is inserted, sealing element 111 is compressed on support surface 210 of the plug housing. To lock the plug in place, it is possible, for example, by means of recesses 214 provided for the purpose, to insert locking elements, which are also constructed as a single locking element, into the plug housing in a direction perpendicular to that of insertion of the plug, so that they extend above the third guide portion or guide element 110 when plug 100 is inserted and, in this way, lock it in place against support surface 210, with the seal therebetween. As a result, a particularly good seal is ensured and, thus, effective protection of contact region 213, while at the same time plug 100 is prevented from dropping out of plug housing 240 due to external forces.

A particular advantage of the plug connection having an inventive plug 100 and an inventive plug housing 210 as illustrated in FIGS. 1 and 2 is that the plug guide is subdivided into a first guide portion 102 and a second guide portion 103. For many applications, especially in the motor vehicle sector, the cable has a considerable unsupported length, typically approximately 300 mm, between the plug and the nearest fastening point (such as, for example, a cable binder). As a result, tensile forces may develop, which mechanically stress the plug and, thus, may cause damage or malfunctions. By dividing the plug guide into a first guide portion 102, which is disposed in a protected, sealed region, and a second guide portion 103, which is disposed outside the protected region, it is possible to make allowances for different designs and requirements for both guide portions. In this regard, the inner guide portion may provide a different arrangement of guide ribs. To permit assembly of the cable (for example, stranded wires), it is possible to wait until after assembly before attaching the second guide region by means of a rigid overmolding. According to an exemplary embodiment of the present invention, second guide portion 103 is produced by an overmolding that joins (e.g., connects) the cable to the plug. Guide ribs 106 and 108 are disposed such that tensile forces due to cable 101 are cushioned. According to empirically determined values, such plug connections need a guide length corresponding to at least twice the diameter of plug face 113. On the other hand, the plug connection should have the smallest possible overall height in order to leave room, for example, for pneumatic lines disposed under it. The diameter D of the plug face that is relevant here is measured in the direction in which the stress acts. Considering a 90° outgoing lead of the plug and cable, a torque will be exerted by the mass not centered on the plug. Accordingly, the guide ratio is considered to be the diameter of the plug face in the direction in which the maximum stress occurs. For the guide length L, in turn, the starting point of the guide length L1 of first guide portion 102 at plug face 113 to the end of the guide length L2 of second guide portion 103 should be considered, as will be further explained hereinafter with reference to FIG. 4. As illustrated in FIGS. 1 and 2, the inventive plug connection achieves a very large guide ratio of L/D=3, for example, where L is the guide length and D is the diameter of the plug face. This is achieved by providing the inner and outer guide. The disconnection travel in this case is L2, and, so, it corresponds to the guide length L2 of second guide portion 103.

According to a further advantageous aspect of the present invention, the first guide portion, or, in other words, the protected inner first guide region 102, has a smaller cross section than the cross section of second guide portion 103. This permits a shorter disconnection travel during extraction of plug 100 from plug housing 240, even though a great guide length L is obtained. This advantage is achieved because plug 100 can already be removed freely from plug housing 240 when the guide portions of the plug have been extracted from their corresponding guides in housing 240. Thus, it is merely necessary to extract second guide portion 103 from the corresponding guide region in order to be able to remove the plug completely from plug housing 240. By virtue of the smaller cross section, the portion of plug 100 in first guide portion 102 can be moved freely in the region of the housing for second guide portion 103. A shorter disconnection travel is of particular advantage, because it can then be ensured that the spatially closest cable binder (or similar fastening device) for cable 101 does not also have to be loosened when the plug is withdrawn.

Plug housings 230 and 220 are configured in a manner similar to that of plug housing 240. To implement preemptive coding, however, coding grooves 237 and 227 are disposed in a manner offset from coding groove 207. Thus, plug 100 according to FIG. 1 cannot be inserted into housings 230, 220.

Figure 3:
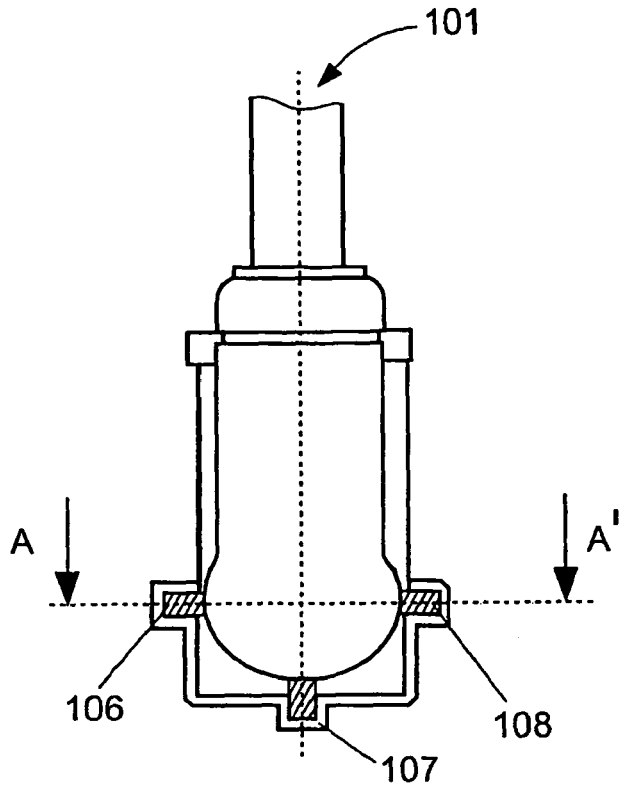
FIG. 3 is an overhead view of a plug in accordance with an embodiment of the present invention.

FIG. 3 is an overhead view of an inventive plug 100, as is illustrated, for example, in FIG. 1. The positions of guide ribs 106 and 108 can be clearly seen in this diagram.

In this view, coding rib 107 is positioned exactly at the middle of the plug housing. For coding purposes, it may be offset to one side or the other in the present diagram, in order to achieve the preemptive coding described above.

Figure 4:
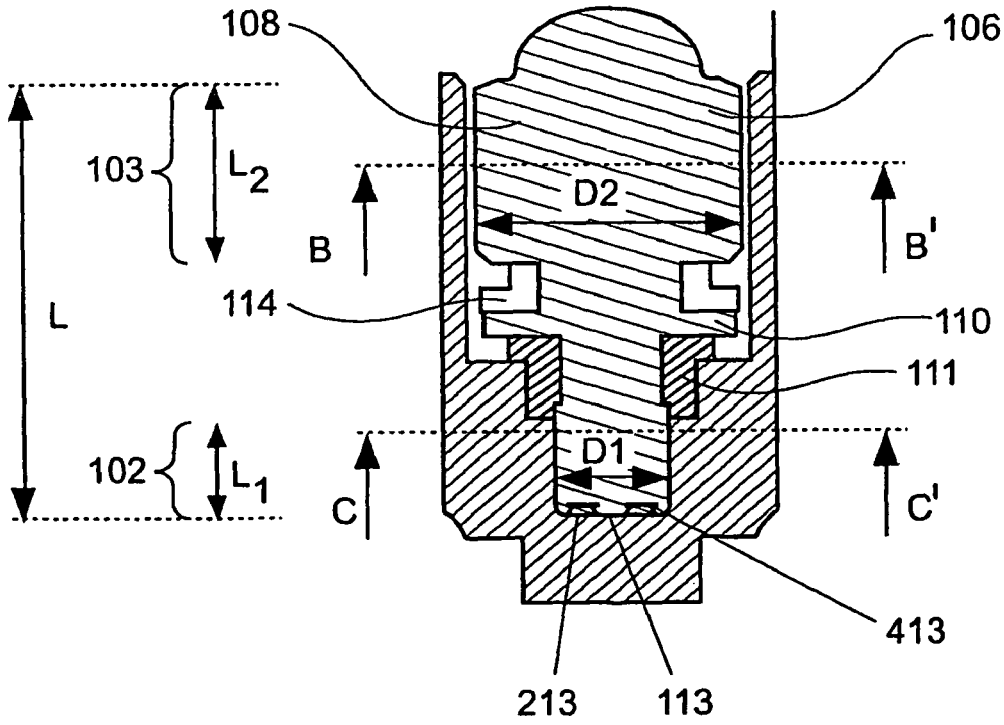
FIG. 4 is a side view of the plug in accordance with an embodiment of the present invention illustrated in FIG. 3.

FIG. 4 shows a sectional diagram taken along section line A-A' of an inventive plug 100 according to the diagram in FIG. 3. This sectional diagram shows how plug 100 is inserted into plug housing 240. In contact region 213 (where plug face 113 is also disposed), contacts 413 are brought together with appropriate corresponding contact means of the plug housing. The contacts can be designed as flat contacts. The diameter D1 of first guide portion 102 is considerably smaller than the diameter D2 of second guide portion 103. Also visible is sealing element 111, which is disposed above first protected guide portion 102, as well as a section through locking element 114, which locks third guide portion 110 in place. Since guide ribs 106 and 108 with cross section D2 project further than first guide portion with cross section D1, the small disconnection travel for extraction of the inventive plug is obtained. Also illustrated here is the ratio of the guide lengths L1 and L2 of first guide portion 102 and of second guide portion 103, respectively, to the total guide length L. The disconnection travel is obtained from the guide lengths L1 of the first guide portion and L2 of the second guide portion. Depending on the ratio between these two guide lengths L1 and L2, a disconnection travel is obtained that can correspond, for example, to either L1 or L2. In an advantageous configuration, the disconnection travel corresponds to guide length L2.

Figure 5:
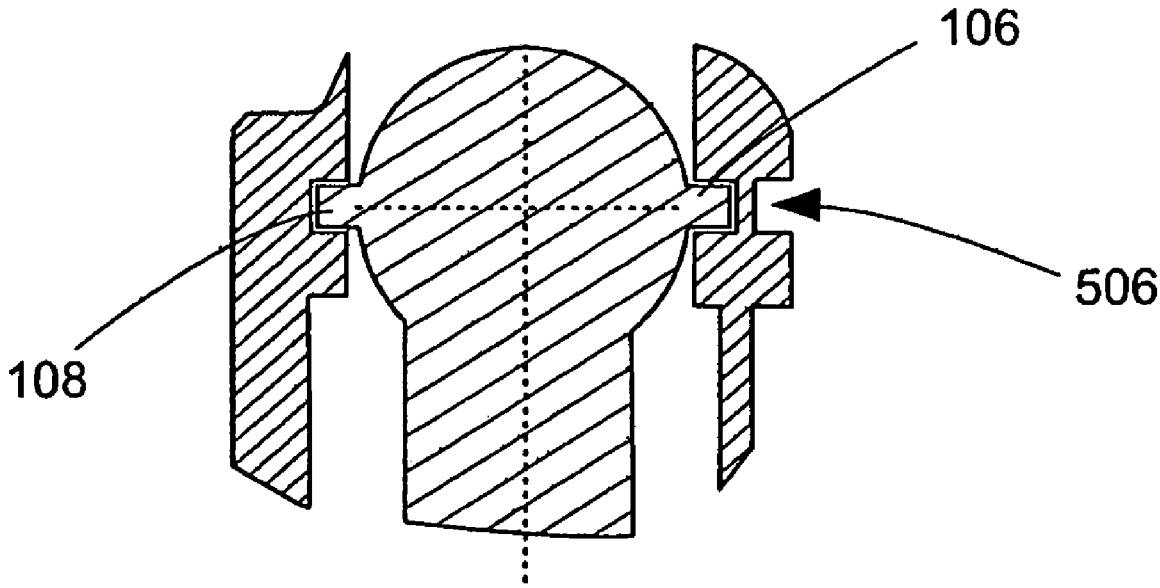
FIG. 5 shows further side views of the plug in accordance with an embodiment of the present invention illustrated in FIG. 4.
Figure 5:
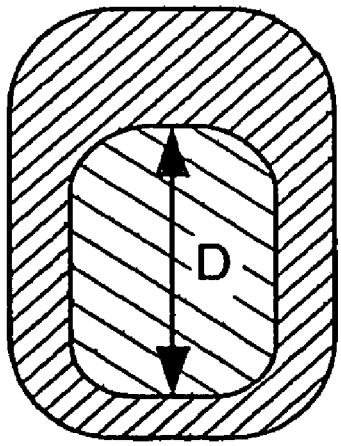

FIG. 5 shows two further sectional views taken along section lines B-B' and C-C', as indicated in FIG. 4. The top diagram of FIG. 4 presents the section along section line B-B', illustrating the arrangement of guide ribs 106 and 108 relative to one another. A further guide rib of an adjacent inventive plug can be disposed in guide groove 506. The sectional view taken along section line C-C' shows the orientation of the controlling cross section D of the plug face. Accordingly, the cross section D of the plug face indicated here is the deciding factor for determination of the relevant guide ratio.

It will thus be seen that the objects set forth above, among those made apparent from the preceding description, are efficiently attained, and since certain changes may be made without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention that, as a matter of language, might be said to fall therebetween.

What is claimed is:

1. A plug comprising a guide, having a first guide portion and a second guide portion that guide said plug in a corresponding plug housing, said first and second guide portions being aligned along an axis orthogonal to a plug face, wherein said second guide portion is disposed further from said plug face than is said first guide portion, and wherein contours of respective cross sections of said first guide portion and said second guide portion are different from one another, and wherein a first guide length of said first guide portion in the direction of insertion of said plug and a second guide length of said second guide portion in the direction of insertion of said plug are configured such that a length for freeing said plug from one or more guides of said corresponding plug housing is one of less than and equal to said guide length of said second guide portion.

2. The plug according to claim 1, wherein said first guide portion and said second guide portion are separated from one another by a third portion that does not guide said plug housing.

3. The plug according to claim 1, wherein said second guide portion is formed by a plug part separate from said first guide portion, said plug part being provided by at least one of a connecting element, an overmolding, and a mounted element, said plug part being rigidly joined to said plug.

4. The plug according to claim 1, wherein said plug has a smaller maximum cross section in said first guide portion than in said second guide portion.

5. The plug according to claim 1, further comprising a guide rib disposed on the circumferential surface of said plug is provided on said second guide portion, said guide rib being oriented in the direction of insertion of said plug.

6. The plug according to claim 4, further comprising a coding rib provided in said second guide portion, said coding rib being offset on the circumferential surface of said plug to engage upon first contact with said plug housing.

7. A plug housing for a plug with guide, said plug including a first guide portion and a second guide portion for guiding said plug in said plug housing, said first and second guide portions aligned along an axis orthogonal to a plug face, wherein said second guide portion being disposed further from said plug face than is said first guide portion, and wherein contours of the cross sections of said first guide portion and said second guide portion being different from one another, said plug housing comprising a first guide groove that corresponds to a first guide rib in said second guide portion and a second guide groove that corresponds to a second guide rib in said second guide portion, said first and second guide grooves being open in the direction of insertion of said plug.

8. A plug connection comprising:

a plug housing; and a plug with guide, said plug including a first guide portion and a second guide portion for guiding said plug in said plug housing, said first and second guide portions being aligned along an axis orthogonal to a plug face, said second guide portion being disposed further from said plug face than said first guide portion, and contours of the cross sections of said first guide portion and said second guide portion being different from one another, wherein a first guide length of said first guide portion in the direction of insertion of said plug and a second guide length of said second guide portion in the direction of insertion of said plug are configured such that a length for freeing said plug from one or more guides of said corresponding plug housing is one of less than and equal to said guide length of said second guide portion, and wherein a ratio between an effective guide length in the direction of a main stress on said plug and the diameter of said plug face is equal to 3.

9. A plug comprising a guide, having a first guide portion and a second guide portion that guide said plug in a corresponding plug housing, said first and second guide portions being aligned along an axis orthogonal to a plug face, wherein said second guide portion is disposed further from said plug face than is said first guide portion, wherein contours of respective cross sections of said first guide portion and said second guide portion are different from one another, and wherein said plug has a smaller maximum cross section in said first guide portion than in said second guide portion, said plug further comprising a coding rib provided in said second guide portion, said coding rib being offset on the circumferential surface of said plug to engage upon first contact with said plug housing.

10. A plug connection comprising:

a plug housing; and a plug with guide, said plug including a first guide portion and a second guide portion for guiding said plug in said plug housing, said first and second guide portions being aligned along an axis orthogonal to a plug face, said second guide portion being disposed further from said plug face than said first guide portion, and contours of the cross sections of said first guide portion and said second guide portion being different from one another, wherein said plug has a smaller maximum cross section in said first guide portion than in said second guide portion, said plug further comprising a coding rib provided in said second guide portion, said coding rib being offset on the circumferential surface of said plug to engage upon first contact with said plug housing, and wherein a ratio between an effective guide length in the direction of a main stress on said plug and the diameter of said plug face is equal to 3.

* * * * *